United States Patent [19]

Harden et al.

[11] 4,147,310

[45] Apr. 3, 1979

[54] APPARATUS FOR COILING WIRE

[75] Inventors: David R. Harden, Washington, Pa.; Hugh E. Southerland, Connellys Springs, N.C.

[73] Assignee: Piedmont Wire Corporation, Connelly Springs, N.C.

[21] Appl. No.: 906,859

[22] Filed: May 17, 1978

[51] Int. Cl.[2] ..... B65H 54/02; B65H 67/04; B65H 75/24; B65H 75/28

[52] U.S. Cl. ..... 242/25 A; 242/19; 242/41; 242/81; 242/110.1; 242/125.1

[58] Field of Search ..... 242/25 A, 25 R, 18 A, 242/18 R, 41, 110.1, 81, 78, 56 A, 53, 19, 48, 125.1

[56] References Cited

U.S. PATENT DOCUMENTS

| | | | |
|---|---|---|---|
| 2,120,944 | 6/1938 | Sedgley | 242/18 A |
| 2,177,311 | 10/1939 | Weimer | 242/18 A |
| 2,868,468 | 1/1959 | Bunch | 242/25 A |
| 2,888,214 | 5/1959 | Wilke | 242/25 A |
| 2,978,194 | 4/1961 | Lloyd et al. | 242/25 A |
| 2,984,425 | 5/1961 | Thayer | 242/18 A |
| 3,148,841 | 9/1964 | Hollingsworth et al. | 242/25 A |
| 3,152,768 | 10/1964 | Astrom | 242/25 A |
| 3,472,461 | 10/1969 | Fredriksson | 242/25 R |
| 3,701,491 | 10/1972 | Brown | 242/25 A |

FOREIGN PATENT DOCUMENTS

| | | | |
|---|---|---|---|
| 979021 | 1/1965 | United Kingdom | 242/25 A |
| 1069134 | 5/1967 | United Kingdom | 242/25 A |
| 1074709 | 7/1967 | United Kingdom | 242/25 A |

*Primary Examiner*—Stanley N. Gilreath
*Attorney, Agent, or Firm*—Buell, Blenko & Ziesenheim

[57] ABSTRACT

An apparatus is provided for coiling wire so that the finished coils are free from central cores or spools and the wire may be removed from the axis free from undesirable lay, comprising a frame having a plurality of rotating arms, each with a collapsing mandrel having a wire gripping means and index means for positioning the mandrel on the arm, wire delivering and directing means delivering wire to a mandrel at a loading station, inserting means at the loading station inserting wire into the gripping means, means rotating the mandrel to form a coil, a mandrel turning means for indexing the mandrel leaving the loading station and an unloading station including removing means for collapsing a mandrel and pushing a complete coil therefrom.

18 Claims, 7 Drawing Figures

APPARATUS FOR COILING WIRE

This invention relates to apparatus for coiling of wire and particularly to apparatus for forming a coil of wire which can be boxed and the wire removed from the center of the coil free from a fixed lay in the wire.

Coiling of wire is a very old and well known practice. Generally, wire is coiled by wrapping on a core, or spool or frame of wire or cardboard or the like which travels with the coil during boxing and shipping. There are many forms of wire strand where it is desirable, however, to be able to make and package the coil without a center core or frame and to be able to withdraw the wire from the center of the coil without disturbing the outer coils and without the wire having a specific lay which causes problems in subsequent use.

We have invented an apparatus which is capable of wrapping a wire strand into a coil without a core member or frame and in a manner such that the coil can be handled, packaged and shipped without disturbing the coil and from which wire can be removed axially without impairment of the coil and without an undesirable lay.

We provide in a preferred embodiment a frame, a main shaft journaled for rotation in said frame, a plurality of radial arms on said shaft, first drive means rotating said shaft, a mandrel shaft journaled through the end of each said radial arm at the end remote from the main shaft, expandable mandrel means on each mandrel shaft, on one side of each arm, a clutch plate on each mandrel shaft on the opposite side of each arm, a mandrel drive shaft journaled in said frame spaced from the main shaft, a resilient pressure plate on said mandrel drive shaft in the path of rotation of said clutch plate, ramp means on one of said clutch plate and pressure plate permitting said clutch plate to ride onto said pressure plate and compress the same to form a pressurized driving connection therebetween, second drive means acting on the mandrel drive shaft for rotating said mandrel shaft and mandrel through said pressure plate and clutch plate, arm index means on the frame engaging and holding a radial arm with the mandrel drive shaft and mandrel shaft in coaxial alignment, wire directing means on the frame spaced from the mandrel drive shaft, generally parallel to the mandrel shafts directing wire to the mandrel being rotated by the mandrel drive shaft in a preselected pattern, connections from said second drive means to the wire directing means driving the same simultaneously with the mandrel shaft, wire feed and tensioning means delivering wire to the wire directing means and mandrel, wire gripper means on each mandrel, wire inserting and severing means on the frame spaced from the mandrel drive shaft and movable radially thereof, to insert a wire into the wire gripper means and sever wire on the gripper means opposite the wire directing means, first sensing means on the frame actuated by the arm indexing means energizing successively said wire inserting and severing means and said second drive means when an arm is indexed, second sensing means on said frame sensing the diameter of a coil of wire on the mandrel being rotated, deenergizing said second drive means when a coil of preselected diameter has been made, releasing said arm indexing means and energizing said first drive means to rotate the main shaft and arms, mandrel indexing means on each arm, means on the frame in the path of rotation of the mandrels rotating a filled mandrel to a preselected index position, and coil removing means on the frame spaced from the mandrel drive shaft compressing the mandrel, releasing the wire gripping means and removing a filled coil therefrom each time the arm indexing means indexes a mandrel with the mandrel drive shaft. Preferably the wire feed and tensioning means is a pair of friction rolls engaging the wire. The wire directing means is preferably a reversing traversing guide designed to deliver the wire to the mandrel in a progressing criss-cross design forming a figure 8 configuration on the mandrel. The wire gripping means on the mandrel is preferably a pair of axially elongate jaws, one fixed and one movable, on a carrier in the mandrel. The mandrel is preferably made up of a pair of spaced apart hubs, one fixed and one movable on the mandrel shaft and having an equal number of radial spokes or arms connected together by elongate links pivoted at one end on the spokes of said opposite hubs and pivoted intermediate their ends so as to be normally expanded outwardly by resilient means acting on the movable hub. Preferably means are provided connected to the coil removing means for moving the movable mandrel hub away from the fixed mandrel hub to straighten or compress the elongate links and open the movable gripping jaw so as to release the coil and permit the coil removing means to shove the coil off the mandrel. Means are provided on the wire directing means for varying the rate of movement of said wire directing means relative to the rotation of the mandrel shaft. Additional means are provided on the wire directing means for selectively permitting the wire directing means to realign with the strand of wire coming from the feed and tension means to the mandrel.

In the foregoing general description of this invention, certain preferred practices and embodiments of this invention have been set forth. Other objects, purposes and advantages of this invention will be apparent from a consideration of the following description and the accompanying drawings in which.

Figure 1:
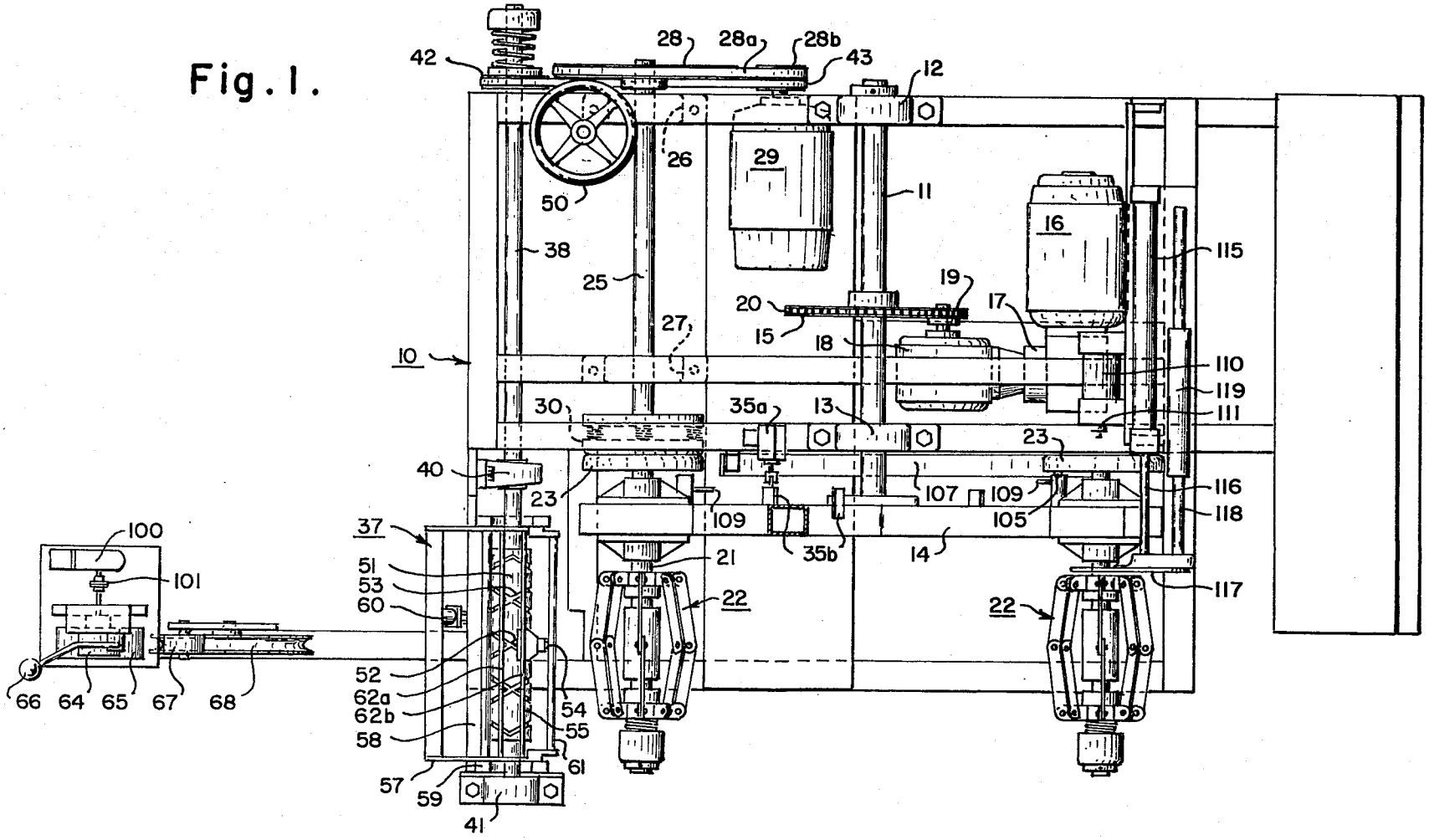
FIG. 1 is a top plan view of an apparatus for forming a spool of wire according to this invention.

Referring to the drawings there is illustrated a frame 10 having a main shaft 11 journaled in bearings 12 and 13 on the frame. One end of shaft 11 has a plurality (preferably four) of radial arms 14 rotatable in a vertical plane. A drive sprocket 15 is mounted on shaft 11 between journals 12 and 13 and is connected to electric motor 16 by means of speed reducers 17 and 18, sprocket 19 and drive chain 20. A mandrel shaft 21 is journaled through the end of each radial arm 14 at the end remote from shaft 11. An expandable mandrel 22 is mounted on one end of mandrel shaft 21. The other end of mandrel shaft 21, on the opposite side of arm 14, carries a circular clutch plate 23 whose outside edge is rounded or chamfered 24 to form a ramp. A mandrel drive shaft 25 is journaled in bearings 26 and 27 on frame 10 spaced from shaft 11 at the loading position for the mandrel. Shaft 25 carries a pulley 28 driven by belt 28*a* and pulley 28*b* on motor 29. The other end of shaft 25 carries a spring loaded pressure plate 30 of substantially the same diameter as clutch plate 23 and which also has its outside edge rounded or chamfered 31 to form a ramp so that as arms 14 are rotated to the loading position the two ramps 24-31 of clutch plate 23 and pressure plate 30 permit the clutch plate 23 to ride onto and engage pressure plate 30 in driving relation with mandrel drive shaft 25 and mandrel shaft 21 in axial alignment. An arm indexing rod 32 is pivoted at one end on frame 10. The other end of rod 32 carries a detent 33 which engages a notch 34 in the end of each arm 14 at the loading station to hold the mandrel drive shaft 25 and mandrel shaft 21 in axial driving alignment. Indexing rod 32 is urged toward the locking or holding position by piston 35 on frame 10. In order to aid the engagement of detent 33 in notch 34, a ramp 36 is formed on each arm 14 ahead of notch 34 to direct detent 33 into the notch 34. The piston 35 is actuated by a micro switch 35*a* on frame 10 which is energized by a finger 35*b* on each arm 14, intermediate its length. A wire directing apparatus 37 is mounted on frame 10 and includes shaft 38 journaled in bearings 39, 40 and 41 on frame 10. Shaft 38 is driven by motor 29 through variable pitch pulley 42 on one end of shaft 38, pulley 28*b* and belt 43 running over pitch adjusting idler pulley 44 on one end of arm 45 whose other end is pivoted 46 on frame 10. The position of idler 44 is regulated by adjusting screw 47 threaded in nut 48 pivoted intermediate the arm 45. Adjusting screw 47 is journaled in bearing 49 on frame 10 and is rotated by handle 50 on the end opposite the nut 48. Moving arm 45 up or down changes the depth of penetration of belt 43 in pulley 42 and thereby the rotational speed of shaft 38. The shaft 38 carries a reversing screw thread head 51 on the end opposite pulley 42. A follower 52 running in the grooves 53 of reversing screw head 51 is pivoted on wire guide 54 slidable on carrier rods 55 and 56 carried by tilting frame 57 pivoted on pin 58 in arm 59 extending from frame 10. Frame 57 is pivoted on pin 58 by cylinder 60 on frame 10. Tilting frame 57 carries roller 61 at its end on the exit side of wire guide 54. Wire 63 is delivered from a coil (not shown), preferably under slight tension, through the nip formed by superimposed rubber coated measuring rolls 64 and 65 which are spring loaded toward each other. A lift lever 66 is provided to raise upper roll 64 in order to feed wire through the nip. The wire from rolls 64 and 65 passes over idler roll 67 and around idler 68, both on frame 10, then over rod 62*a*, under rod 62*b*, through wire guide 54, over roller 61 and under mandrel 22. Each mandrel 22 is provided with a wire gripper in the form of an axial elongate fixed jaw 69 and an interengaging elongate axial movable jaw 70 mounted on an intermediate carrier 71 fixed to mandrel shaft 21. The fixed jaw 69 carries a replaceable radially extending cutting blade 72 held in slot 73 by screws 74. The movable jaw 70 is urged to normally closed position by a spring 75 acting on bell crank 76 one end of which is connected to movable jaw 70 and other end is connected to slot 77 in one end of a rod 78, the other end of which rod is connected to movable hub 79 of mandrel 22.

The mandrel 22 is made up of a fixed hub 80 fixed on mandrel shaft 21 and a spaced hub 79 movable axially on mandrel shaft 21. The two hubs are separated by carrier 71, described above. The hub 79 and 80 are provided with a plurality of radial spokes 81 connected at their outer ends by elongate links 82 and 83 pivoted together at one end on pin 84 intermediate hubs 79 and 80 and at the other end to one of hubs 79 and 80. Hub 79 is normally urged toward carrier 71 by spring 85. A control rod 86 extends through a hollow bore 87 in mandrel shaft 21. One end of rod 86 is connected to hub 79 and the other end terminates within clutch plate 23. Its operation will be described later.

An elongate wire inserting head 90 and anvil 90*a* is mounted on the end of piston 91 in cylinder 92 fixed on frame 10 below center line of mandrel drive shaft 25. The head 90 is adapted to force wire 63 between jaws 69 and 70 and the anvil 90*a* is adapted at the same time to force the wire against cutter blade 72 to sever the wire.

Sensing means 94 in the form of a micro-switch is mounted on frame 10 and engages indexing rod 32. This sensing means 94 signals the fact that the arm is properly indexed and actuates cylinder 92 to force wire 63 into the gripping jaws 79-80. When the piston 91 returns into cylinder 92, sensing means 95 is actuated by lever 96 on guide arm 97 on inserting head 90. Actuation of sensing means 95 signals that the wire is inserted and actuates a cylinder 98 having a piston and arm 99 which engages detent operator arm 109 on detent 105 to remove it from recess 106 in clutch plate 23, motor 29 which drives mandrel 22 and wire directing shaft 38 is then actuated. This causes the mandrel 22 to draw wire from between rolls 64-65 through wire guide 54 which moves back and forth along reversing screw head 51 at a rate selected to deposit wire on the mandrel in a preset pattern such as an incrementally advancing FIG. 8.

Figure 2:
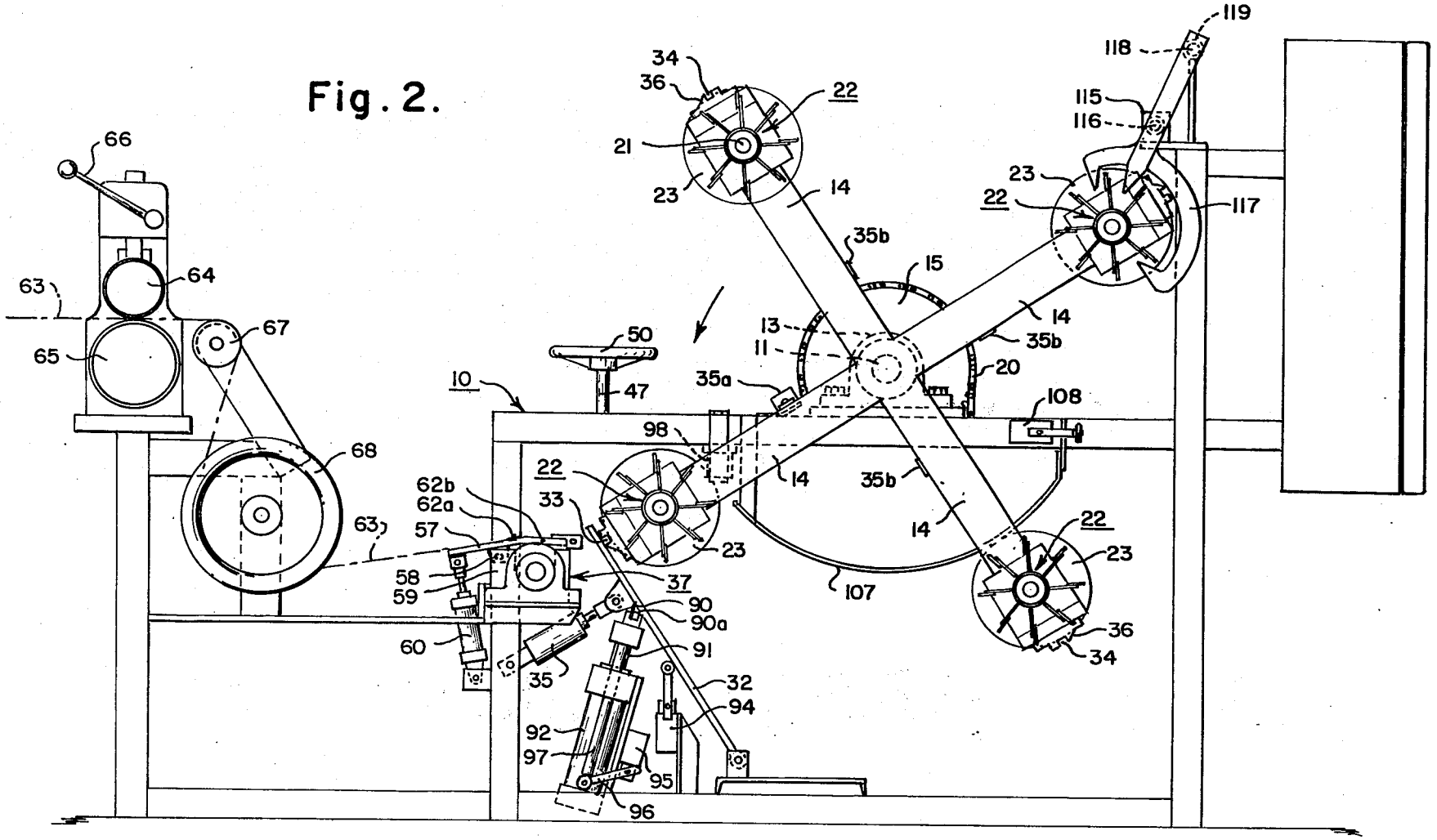
FIG. 2 is a front elevational view of the apparatus of FIG. 1.
Figure 3:
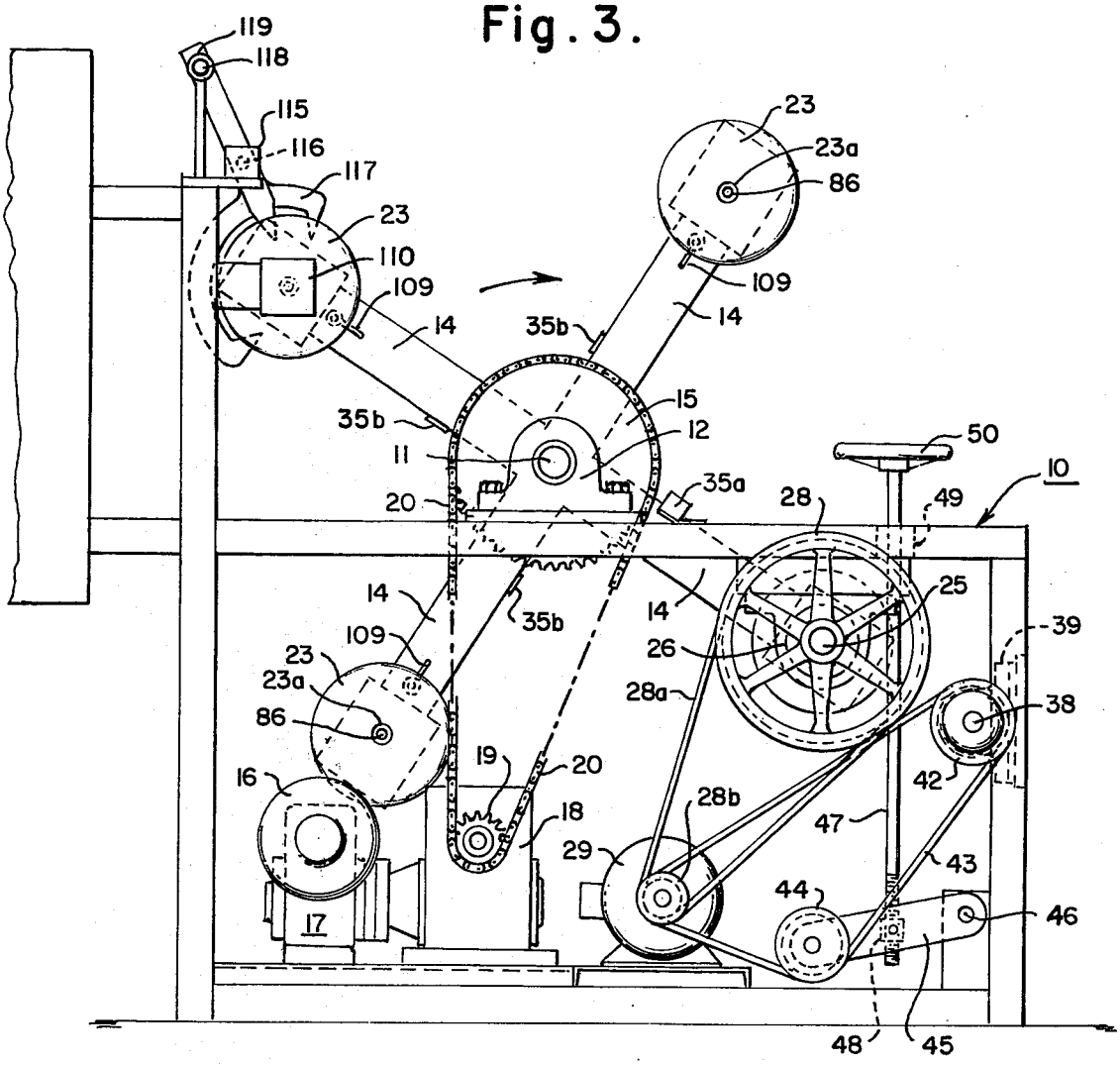
FIG. 3 is a rear elevational view of the apparatus of FIG. 1.
Figure 4:
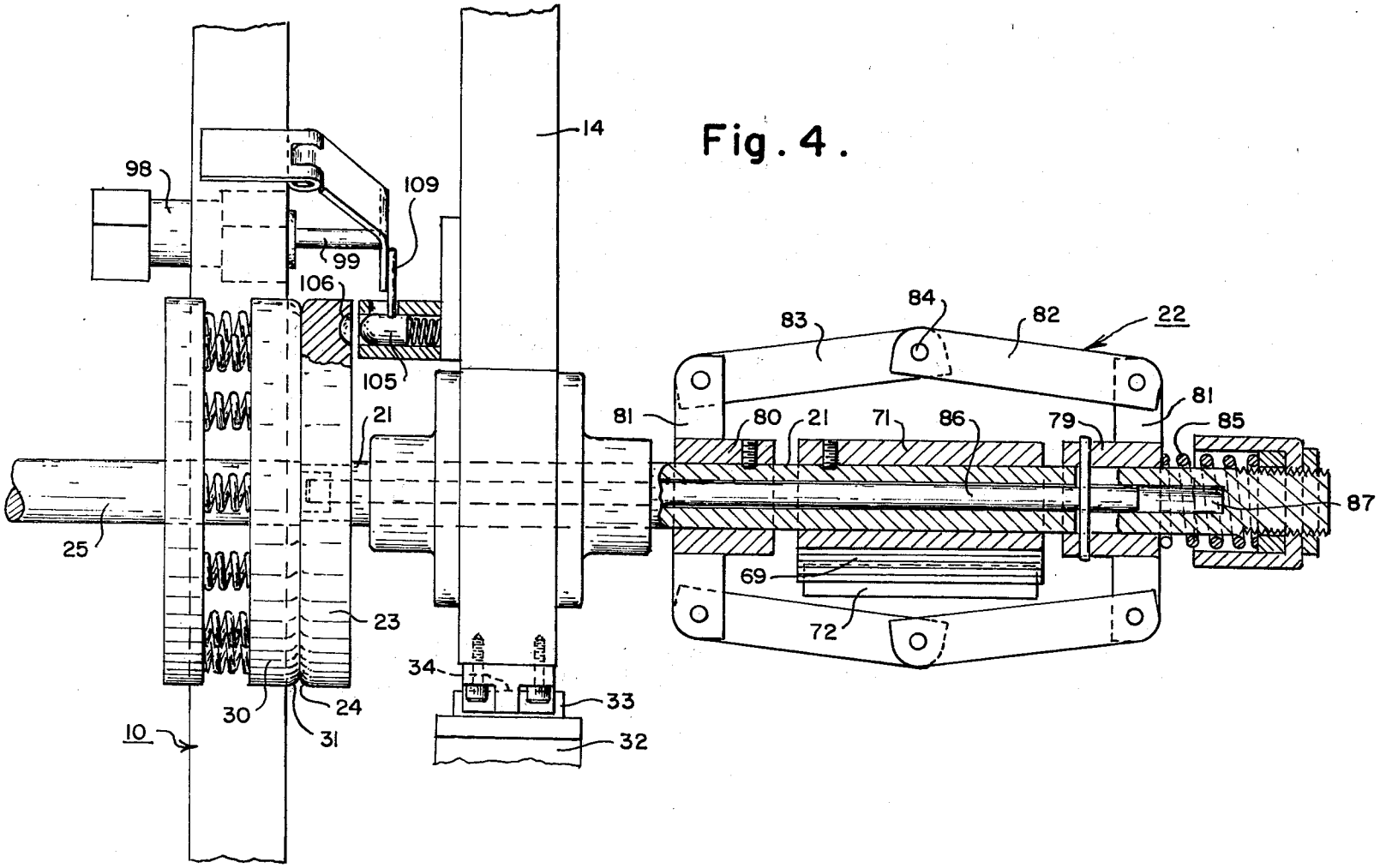
FIG. 4 is a fragmentary elevation of the mandrel and drive at the coiling position or station.
Figure 5:
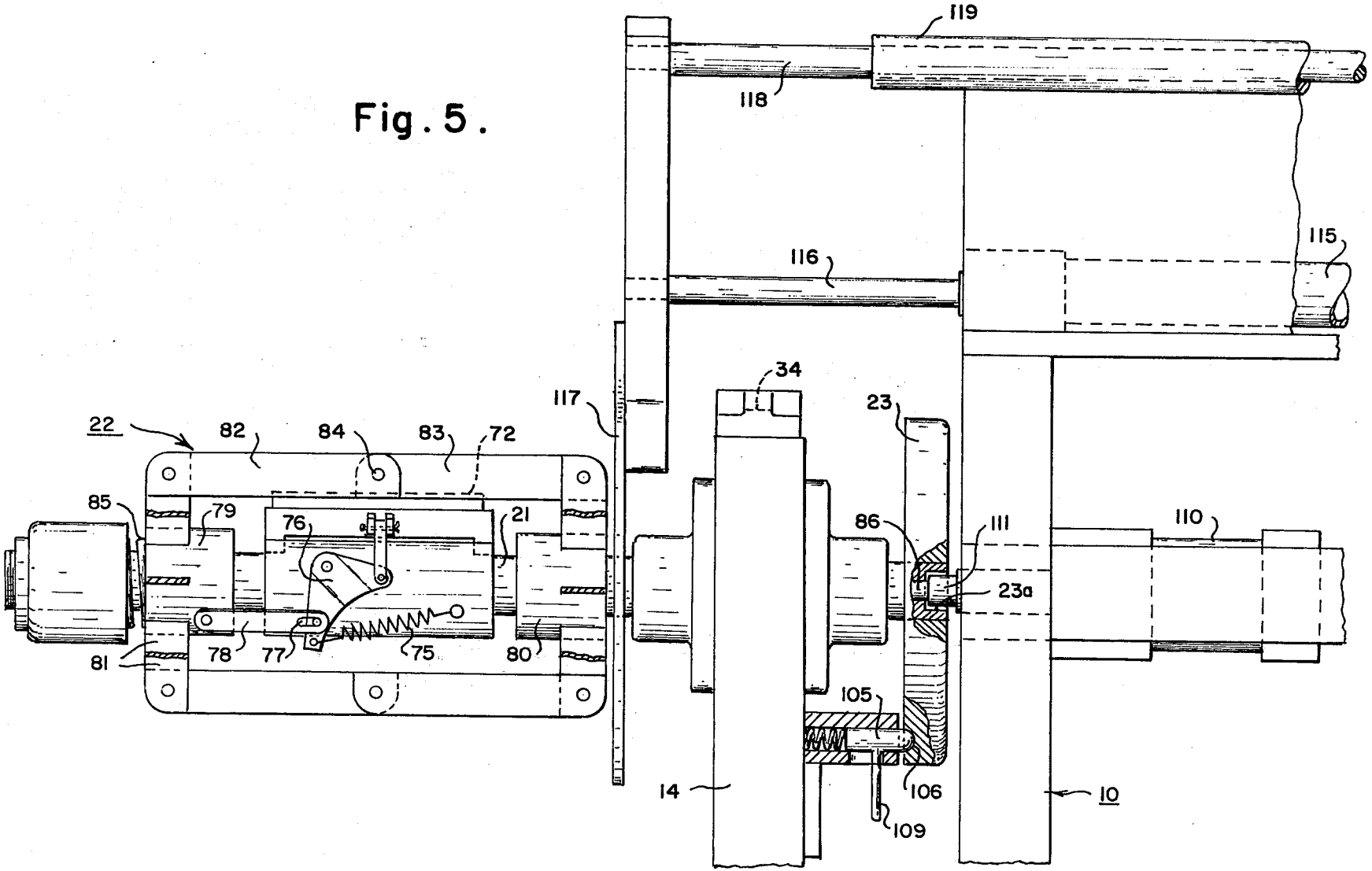
FIG. 5 is a fragmentary elevation, partly in section, of the mandrel and drive at the discharge station or position.
Figure 6:
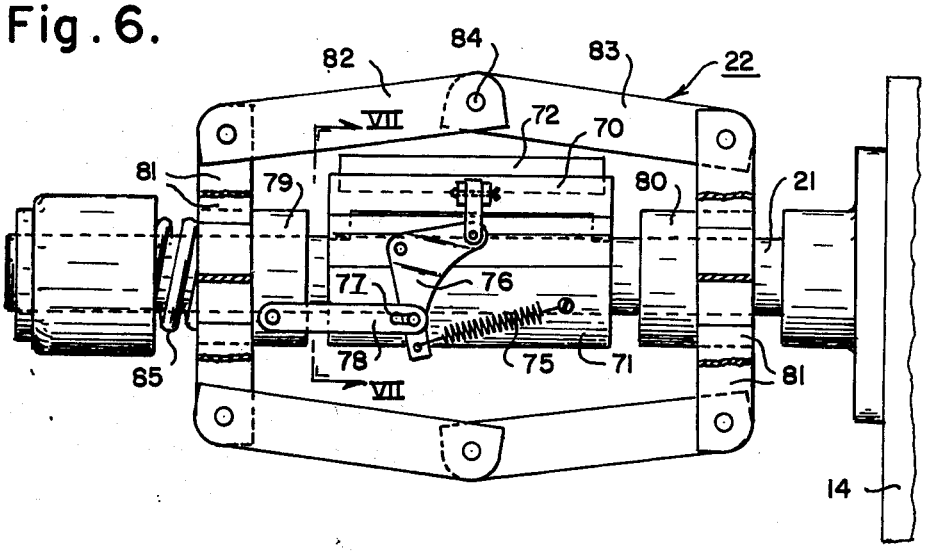
FIG. 6 is an enlarged elevational view of a mandrel assembly of FIG. 1.
Figure 7:
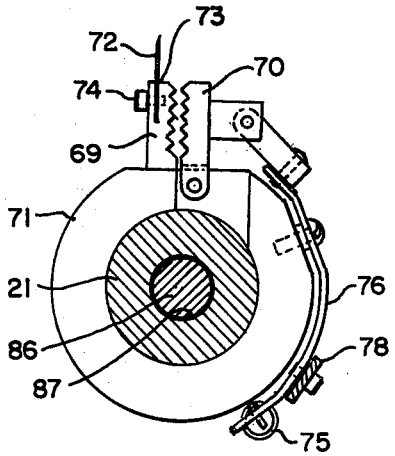
FIG. 7 is a fragmentary section on the line VII—VII of FIG. 6.

When the coil of wire on mandrel 22 has reached the desired diameter, which is determined by a counter 100 driven by roll 65 through flexible coupling 101, motor 29 is deenergized, cylinder 35 is actuated to remove detent 33 from notch 34 and motor 16 is energized to rotate shaft 11 counterclockwise viewing FIG. 2 to bring the next empty mandrel 22 into position with detent 33 engaging notch 34. As the completed coil moves counterclockwise, clutch plate 23 engages a curved runner plate 107 provided on frame 10 to engage the outer periphery of clutch plate 23 to rotate the mandrel and clutch plate to engage detent 105 in recess 106.

An unloading station is provided following runner plate 107. However, before reaching the unloading station a sensing member 108, in the form of a micro-switch, lies in the path of travel of detent operator rod 109 in the open position. In the event that this switch is energized, indicating that the detent has not seated in recess 106, a warning signal is sounded and motor 16 is deenergized. If the detent is properly seated shaft 11 rotates until detent 33 engages notch 34 at the loading or winding station previously described. At this point a cylinder 110 is actuated by sensing means 94 to extend piston 111 axially into opening 23*a* in the center of clutch plate 23 and into engagement with control rod 86. This causes hub 79 to be moved axially away from hub 80 and collapses links 82 and 83 to release the coil of wire formed thereon and at the same time opens gripping jaw 70 to release the wire end held between jaws 69 and 70. Simultaneously with actuating cylinder 110, cylinder 115 is actuated. This causes piston 116 to push coil remover 117 through between the collapsed links 82-83 of mandrel 22 to push the completed released coil from the mandrel. A guide 118 slidable in guide tube 119 parallel to cylinder 115 and piston 116 is provided to carry coil remover 117 and hold it in position relative to the mandrel 22. As soon as the coil of wire has been pushed from mandrel 22, cylinder 115 withdraws coil remover 117 from mandrel 22 and the apparatus is ready to repeat its operation as soon as the next coil is completed and shaft 11 rotated to bring a completed coil to the unload station.

In the foregoing specification we have set out certain preferred practices and embodiments of our invention, however, it will be understood that this invention may be otherwise embodied within the scope of the following claims.

We claim:

1. Apparatus for coiling wire, characterized in that the finished coils are free from central cores or spools and the wire may be removed from the axis free from undesirable lay, comprising a frame, a main shaft journaled for rotation in said frame, a plurality of radial arms on said shaft, first drive means rotating said shaft, a mandrel shaft journaled through the end of each said radial arm at the end remote from the main shaft, expandable mandrel means on each mandrel shaft, a mandrel drive shaft journaled in said frame spaced from the main shaft identifying a coiling station, releasable connecting means between each mandrel shaft and said mandrel drive shaft, a second drive means on the frame acting on the mandrel drive shaft for rotating the same, arm indexing means on the frame engaging and holding a radial arm with the mandrel shaft and mandrel drive shaft in coaxial alignment, wire directing means on the frame spaced from the mandrel drive shaft and generally parallel to the mandrel shaft at the coiling station directing wire to the mandrel in a preselected pattern, means on the frame driving said wire directing means simultaneously and in preselected relation with the mandrel shaft, wire feed means delivering wire to the wire directing means and mandrel at the coiling station, wire gripper means on each mandrel, wire inserting means on the frame spaced from the mandrel drive shaft and movable radially thereof to insert a wire into the wire gripping means, severing means on said wire gripping and wire inserting means severing wire at the gripping means, first sensing means on the frame actuated by the arm indexing means energizing successively said wire inserting and severing means and said second drive means when an arm is indexed at the coiling station, second sensing means on said frame sensing the diameter of a coil of wire on the mandrel being rotated and successively deenergizing said second drive means when a coil of pre-selected size has been made, releasing said indexing arm and energizing said first drive means to rotate the main shaft and arms, mandrel indexing means on each arm, means on the frame in the path of rotation of the mandrel rotating a filled mandrel to a preselected index position and coil removing means on the frame spaced from the mandrel drive shaft and defining an unloading station, said coil removing means compressing the mandrel, releasing the wire gripping means and removing a filled coil from the compressed mandrel each time the arm indexing means indexes a mandrel at the coiling station.

2. Apparatus for coiling wire as claimed in claim 1 wherein the connecting means between the mandrel shaft and mandrel drive shaft is a generally circular clutch plate on one and a like generally circular resilient pressure plate on the other.

3. Apparatus for coiling wire as claimed in claim 2 wherein the circumferential edges of the adjacent surfaces of each plate are chamfered to form a ramp permitting the two to ride onto one another to become coaxially aligned.

4. Apparatus as claimed in claim 1 wherein the wire feed means is a pair of friction rolls engaging the wire.

5. Apparatus as claimed in claim 4 wherein the rolls are rubber coated and spring loaded.

6. Apparatus as claimed in claim 1 wherein the wire directing means is a reversing traversing guide delivering wire to the mandrel in a progressive criss-cross design of generally figure 8 configuration.

7. Apparatus as claimed in claim 6 wherein the guide normally runs in a reversing screw groove to deliver wire in said preselected configuration and means are provided on the frame for separating said guide from said screw to permit the guide to follow the natural line of the wire from the feeding roll to the mandrel at the time a filled mandrel is moved from the coiling station.

8. Apparatus as claimed in claim 1 wherein the wire gripping means is a pair of axially elongate jaws, one fixed and one movable on the mandrel shaft and means acting on said movable jaw normally urging it into tight contact with the fixed jaw.

9. Apparatus as claimed in claim 1 wherein the mandrel comprises a pair of spaced hubs one fixed to the mandrel shaft and the other slidable coaxially thereon, an equal number of radial spokes on each hub and elongated links, pivoted intermediate their ends and pivoted at one end to a spoke on the fixed hub and at the other end to a spoke on the movable hub.

10. Apparatus as claimed in claim 9 wherein the movable hub is resiliently urged toward the fixed hub and is connected to an actuator rod extending coaxially within the mandrel shaft.

11. Apparatus as claimed in claim 10 wherein the wire gripping means is a pair of axially elongate jaws, one fixed and one movable on the mandrel shaft intermediate the movable and fixed hubs, means connected to said movable jaw normally urging the movable jaw into tight contact with the fixed jaw and connecting means between said movable jaw and movable hub whereby said jaw is opened when said movable hub is moved away from the fixed hub.

12. Apparatus as claimed in claim 1 having indexing means on each arm engaging the mandrel thereon to hold it in pre-selected position relative to said arm.

13. Apparatus as claimed in claim 12 wherein the indexing means is a spring loaded detent on said arm engaging an opening in said mandrel.

14. Apparatus as claimed in claim 1 wherein the wire inserting means is a fluid operated piston having an elongate edge engaging a wire and forcing it into the wire gripping means.

15. Apparatus as claimed in claim 14 wherein the wire gripper means is a pair of axially elongate jaws, one fixed and one movable on the mandrel shaft and means acting on said movable jaw normally urging it into tight contact with the fixed jaw and said elongate edge enters in between said elongate jaws to deposit the wire therein.

16. Apparatus as claimed in claim 15 wherein said fixed jaw carries an elongate knife edge and said piston carries an anvil between which the wire is cut.

17. Apparatus as claimed in claim 1 wherein the coil removing means is a plurality of fingers passing along the mandrel to push a wire coil therefrom, said fingers being carried by a fluid actuated piston on said frame.

18. Apparatus as claimed in claim 17 wherein a second fluid piston adjacent the piston carrying said fingers compresses said mandrel immediately preceding movement of said fingers.

* * * * *